US005852873A

United States Patent [19]

Pollkötter

[11] Patent Number: 5,852,873

[45] Date of Patent: Dec. 29, 1998

[54] METHOD OF MANUFACTURE OF A ROTATIONALLY SYMMETRICAL PART

[75] Inventor: Günter Pollkötter, Beckum, Germany

[73] Assignee: Leico GmbH & Co. Werkzeugmaschinenbau, Ahlen, Germany

[21] Appl. No.: 787,178

[22] Filed: Jan. 23, 1997

[30] Foreign Application Priority Data

Jan. 23, 1996 [DE] Germany ..... 196 02 298.3

[51] Int. Cl.[6] ..... B21K 1/32

[52] U.S. Cl. ..... 29/894.324; 29/892.2; 72/110

[58] Field of Search ..... 29/894.32, 894.324, 29/893.35, 892.2, 892.3; 72/110

[56] References Cited

U.S. PATENT DOCUMENTS

| | | | |
|---|---|---|---|
| 4,532,786 | 8/1985 | Schaible | 29/894.324 |
| 4,749,375 | 6/1988 | Guevel et al. | 29/892.2 |
| 5,237,745 | 8/1993 | Yamanaka | 72/68 |

FOREIGN PATENT DOCUMENTS

| | | | |
|---|---|---|---|
| 3519719 | 12/1986 | Germany | 29/892.2 |
| 61-129241 | 6/1986 | Japan | 29/892.2 |
| 63-63543 | 3/1988 | Japan | 29/892.2 |
| 92/01523 | 2/1992 | WIPO | 29/892.3 |

*Primary Examiner*—P. W. Echols
*Attorney, Agent, or Firm*—Oblon, Spivak, McClelland, Maier & Neustadt, P.C.

[57] ABSTRACT

A method of manufacture of a rotationally symmetrical part, particularly a vehicle wheel. In this method, the outer circumferential area of a circular blank is upset for forming a material accumulation or gathering and this preferably takes place asymmetrically. Subsequently, the outer circumferential area of the circular blank is radially split using a splitting roll, which forms two legs. The two legs are subsequently given the desired shape by the utilization of spinning rolls.

10 Claims, 3 Drawing Sheets

METHOD OF MANUFACTURE OF A ROTATIONALLY SYMMETRICAL PART

BACKGROUND OF THE INVENTION

1. Field of the Invention

The invention relates to a method of manufacture of a rotationally symmetrical part, particularly a vehicle wheel, from a circular blank, in which the circular blank is radially split on its outer circumferential area by means of a splitting roll for producing two legs, which are subsequently brought to a desired shape. Such method is used in the manufacture of a motor vehicle wheel or a belt pulley. An important advantage of this method is that the end product can be made from a single material piece. Thus, this method is price-effective with respect to manufacture and ensures good strength characteristics in the end product.

2. Discussion of the Background

As a function of the desired shape of the end product, in a known method, the circular blank is split concentrically or eccentrically into two legs. In eccentric splitting, a problem exists in that the splitting roll tends to run to the side of the blank having the lowest strength. Therefore the splitting roll migrates to the side having the narrower leg, which leads to an undesired, nonuniform splitting.

An asymmetrical material distribution between the two legs can also be obtained in that use is made of a circular blank having a relatively large external diameter. After splitting, the leg requiring a lower material accumulation is cut to length in a separate operation. Therefore this method requires an additional operation, which also leads to further material waste.

DE 32 39 675 C2 discloses a method for the manufacture of a one-piece vehicle wheel, where for obtaining an asymmetrical material distribution the outer circumferential area of the circular blank is bent to one side. In the case of concentric splitting of the blank, consequently, material gathers on one leg and a material reduction occurs on the other.

SUMMARY OF THE INVENTION

The object of the invention is to provide a method for the manufacture of a rotationally symmetrical part from a circular blank, in which it is possible to produce two legs with a free material distribution on both legs.

Based on a method according to the present invention this object is achieved in that the outer circumferential area of the circular blank is upset prior to splitting for forming a material gathering. Due to upsetting, it is possible prior to splitting to obtain a desired material accumulation on the outer circumferential area. Therefore there is a corresponding diameter reduction of the blank. The material accumulation resulting from upsetting can be symmetrical or asymmetrical with respect to the center line of the blank width.

A particularly preferred embodiment of the inventive method consists of the material gathering being formed asymmetrically to the centerline of the blank width in the outer circumferential area of the blank. This makes it possible to produce a leg having a large material gathering and a leg with little or no material gathering. Material gathering at both ends of the leg to be split also makes it possible during the subsequent deformation of the leg to provide for material thickness changes to the leg obtained. Particularly in the case of a vehicle wheel for pneumatic tires, in the vicinity of the rim bed a hump is made on the outer end regions of the rim. Such a hump is provided on both sides of the rim, roughly 2 cm from the rim edge and serves to ensure that when taking a curve the tire cannot slide into the interior of the rim bed. The method according to the invention makes it possible to produce such humps for vehicle wheels without excessive deformation of the leg areas.

In this further development of the method according to the invention with the asymmetrical upsetting there is a clearly defined material distribution on both legs to be formed. For this clearly defined material distribution it is necessary to choose a one-piece circular blank from a constant thickness metal sheet with a correspondingly larger diameter. Only after upsetting does the circular blank have the external diameter provided for splitting purposes. The material corresponding to the diameter reduction forms preplanned rotationally symmetrical material beads on the circumferential edge of the blank.

According to the invention, a particularly accurate material distribution can be obtained by carrying out upsetting with an upsetting roll. On its circumferential area the upsetting roll has a clearly defined circular groove, whose ends shape the upsetting bead on the blank.

A further advantageous variant of the method according to the invention consists of the outer circumferential area of the material gathering being formed substantially perpendicular to the splitting direction. Therefore the circumferential edge of the circular blank, after upsetting, is parallel to the blank rotation axis. Thus, at the start of the splitting process, the splitting roll tip is substantially perpendicular to the outer circumferential area of the circular blank. This reduces the risk of deviation or migration of the splitting roll at the start of the splitting process.

An additional possibility for increasing the reliability and accuracy of the splitting process consists of providing the outer circumferential area of the material gathering with a serration for guiding the splitting roll. This serration has a relatively small depth and is adapted to the shape of the splitting edge of the splitting roll. During upsetting, the serration can be produced with a projecting edge on the splitting roll.

Fundamentally, splitting can be carried out by means of a splitting roll at a random point on the circumferential edge. However, preferably, splitting takes place concentrically to the blank width of the non-upset blank. This also leads to a uniform splitting of the non-upset circumferential area of the circular blank.

According to another embodiment of the invention, it is advantageous for the two legs to be deformed with at least one spinning roll after splitting. In the same manner as the upsetting and splitting roll, the spinning rolls can be moved laterally and radially up to the circular blank. The blank remains in its rotatable fixing device. For performing the deformation process use can be made of one or more spinning rolls with different shapes.

According to another embodiment of the invention, it is advantageous that the circular blank is prebent prior to upsetting. As a result of such a prebending or predeformation of the blank, particularly in its central area, a desired work-hardening is obtained. This obviates any risk of a possible undesired deformation of the circular blank during the following upsetting and splitting process.

In another advantageous embodiment of the method according co the invention, the circular blank is laterally supported during upsetting and/or splitting. Support can be provided by support rolls. The support rolls are arranged in a pairwise, parallel-facing manner, one roll being in contact with one side of the blank and the second roll being in contact with the other blank side. These support rolls ensure that the outer circumferential area does not break out laterally due to the upsetting or splitting forces.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DESCRIPTION OF THE PREFERRED EMBODIMENT

Figure 1:
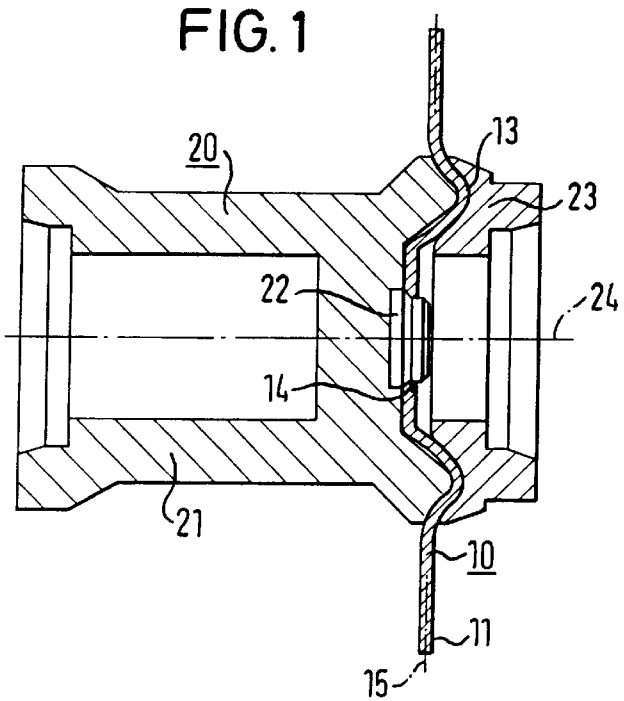
FIG. 1 shows a diagrammatic cross-sectional view of a fixed circular blank in an initial state.

In FIG. 1 a circular blank 10 is fixed in a rotatable spindle unit 20. The circular blank 10 is positioned concentrically to a rotational axis 24 on a headstock 21 by means of a centering element 22, which engages in an opening 14 of the blank 10. The circular blank 10 is fixed to the headstock 21 by means of a counterpart 23. In this embodiment a circular blank 10 is prebent in a preceding shaping process, prebent portion 13 being produced for stiffening purposes.

However, on its outer circumferential area 11 the blank 10 is as yet unbent and has a constant material thickness. In the outer circumferential area 11 the center of the blank thickness is indicated by the centerline 15.

According to the invention, the circular blank 10 fixed in the spindle unit 20 undergoes an upsetting process. Radially to the rotational axis 24, an upsetting device 30 with an upsetting roll 31 is supplied to the circular blank 10 rotating with the spindle unit 20.

The upsetting roll 31 mounted in a rotary manner about an axis 34 in a support frame 33 has a circular groove 32, which has a shape corresponding to the desired shape of a material gathering 12 on the blank 10.

Initially the upsetting roll 31 is sufficiently infed to the circular blank 10 so that the outer circumferential area 11 engages in the circular groove 32. Through further infeeding of the upsetting roll 31 radially to the rotational axis 24, the outer circumferential area 11 of the blank 10 is upset. Corresponding to the circular groove 32, a bead-like material gathering 12 is formed and is asymmetrical to the centerline 15 of the blank 10.

For a particularly precise shaping of the material gathering 12 and for preventing bending of the circular blank 10 during the upsetting process, support rolls 35 are provided on the upsetting device 30. The support rolls 35 in each case rotate about rotational axes 36, which are substantially perpendicular to the rotation axis 24 and rotation axis 34 of the upsetting roll 31. The two support rolls 35 are parallel and offset, the spacing of the two support rolls 35 corresponding to the material width of the blank 10. The two support rolls 35 are also so constructed and positioned that they contribute to the shaping of the bead-like material gathering 12.

At the end of the upsetting process the upsetting device 30 is removed from the circular blank 10 and a splitting device 40 is moved up to the latter. The splitting device 40 has a splitting roll 41 with a splitting edge 42, the splitting roll 41 being mounted in rotary manner about an axis 44 on a support frame 43, said axis 44 being parallel to the rotational axis 24. The splitting roll 41 is wedge-shaped and is symmetrical to a center plane 47. The infeeding of the splitting roll 41 to the material gathering 12 of the circular blank 10 takes place radially, so that the splitting edge 42 is oriented substantially perpendicularly to the edge of the blank 10 and the center plane 47 is aligned with the center-line 15 of the blank 10. Through further radial infeeding of the splitting roll 41, there is consequently a central splitting of the outer circumferential area 11 of the blank 10.

Figure 3:
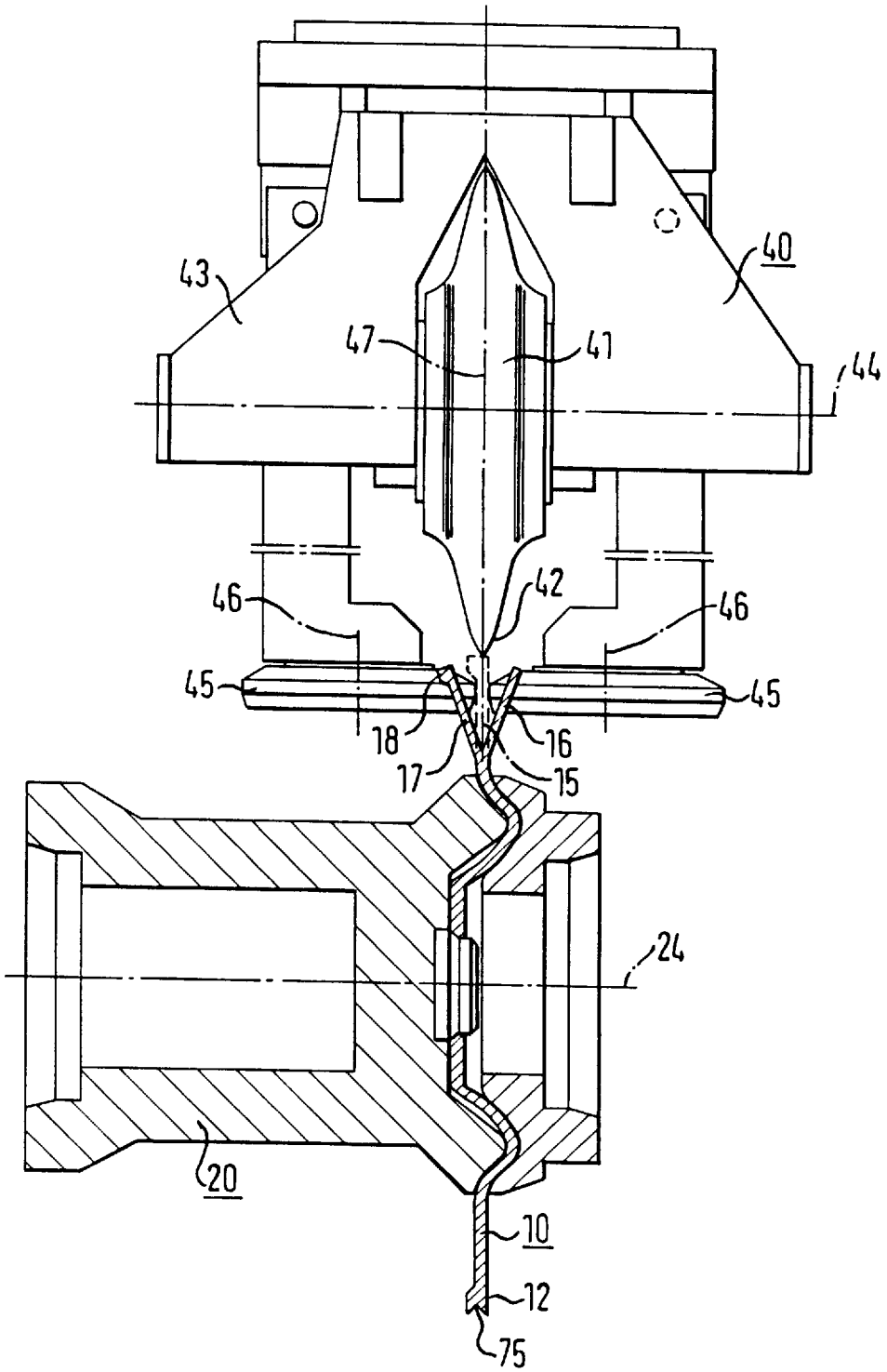
FIG. 3 is a diagrammatic cross-sectional view of a circular blank during the splitting process.

In the upper half of the blank 10 in FIG. 3 it is possible to see in diagrammatic form the result of the splitting process, namely the formation of two legs 16 and 17. As a result of the preceding upsetting, leg 17 has at its free end a material accumulation 18. However, in this embodiment, the other leg 16 has no significant material gathering.

Figure 2:
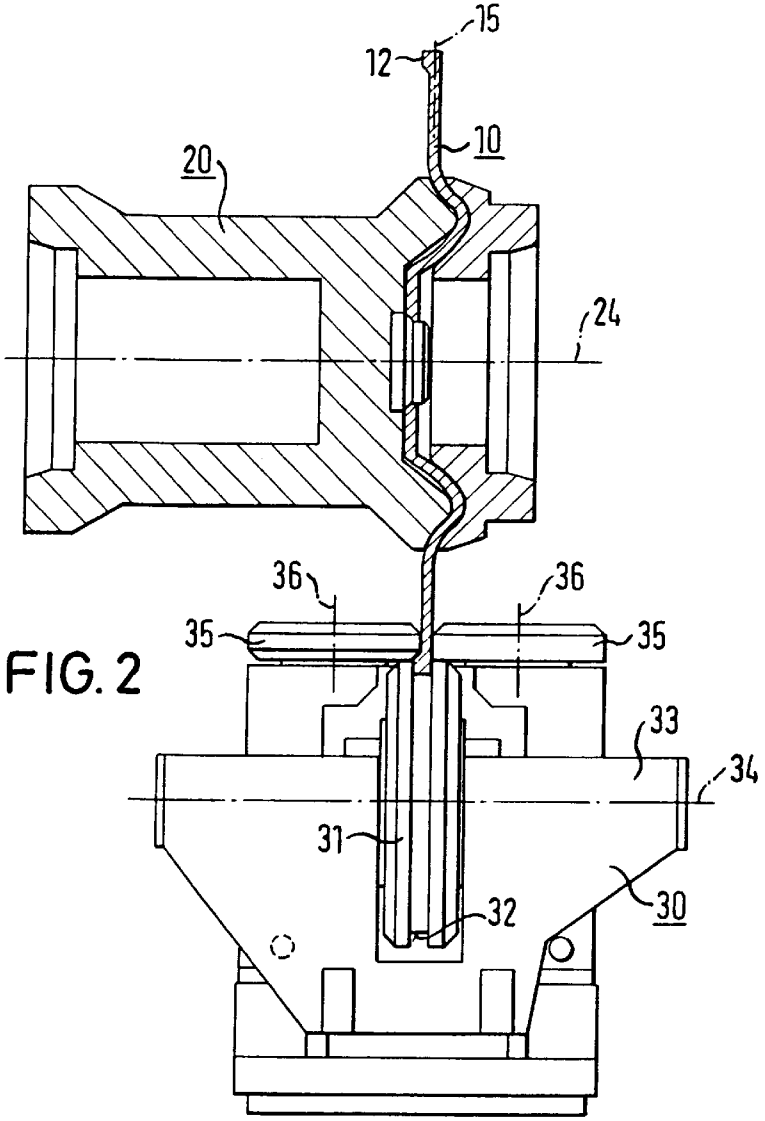
FIG. 2 illustrates a diagrammatic cross-sectional view of a circular blank during the upsetting process.

For carrying out a precise splitting process, support rolls 45 are also provided on the splitting device 40. In much the same way as for the support rolls 35 of the upsetting device 30, according to FIG. 2 the support rolls 45 are mounted so as to rotate about rotational axes 46 on the support frame 43, the rotational axes 46 being perpendicular to the rotational axis 24 and the rotational axis 44 of the splitting roll 41.

Figure 4:
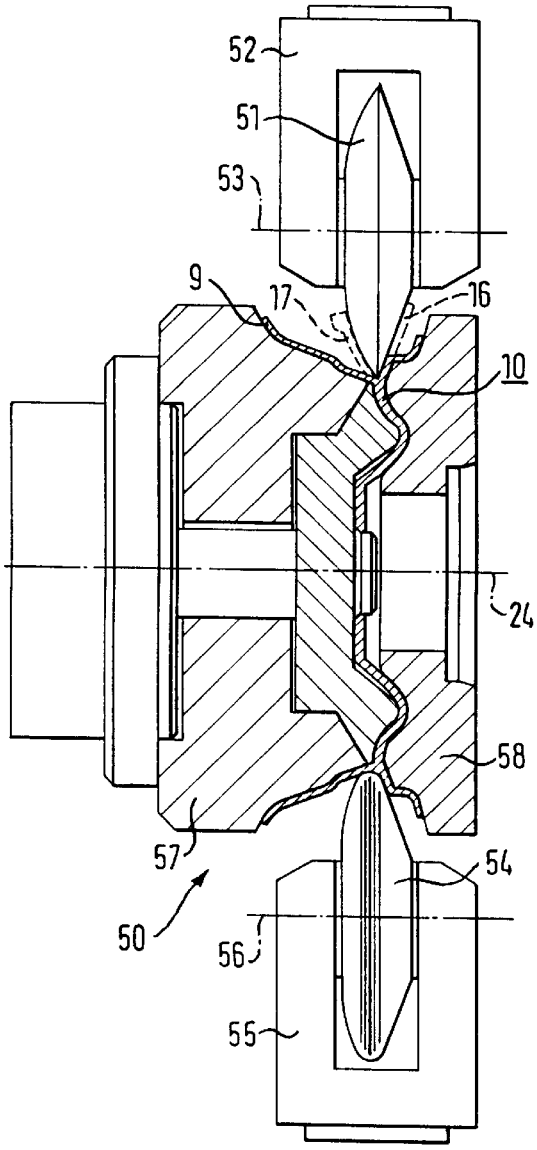
FIG. 4 shows a diagrammatic cross-sectional view of a circular blank during a shaping process.

At the end of the splitting process, the upset and split circular blank 10 is reclamped in a shaping device 50 shown in FIG. 4. It is constructed in much the same way as the previously described spindle unit 20. Additionally the shaping device 50 has a first and a second spinning chuck 57, 58 between which is located the circular blank 10.

The two spinning chucks 57, 58 rotate together with the blank 10 about the rotation axis 24. The spinning chucks 57, 58 are provided with a contour on their outer circumferential areas. By means of a first and a second spinning roll 51, 54 the legs 16, 17 of the blank 10, shown in broken line form im the upper half of the drawing, undergo deformation and conform to the contour of the chucks 57, 58. During this spinning process there can be a material thinning and consequently a stretching of the legs 16, 17. At the end of this first shaping step using the spinning rolls 51, 54, which are mounted in each case so as to rotate about rotational axes 53, 56 on roll holders 52, 55, the outer circumferential area of the blank 10 has an intermediate shape 9.

Figure 5:
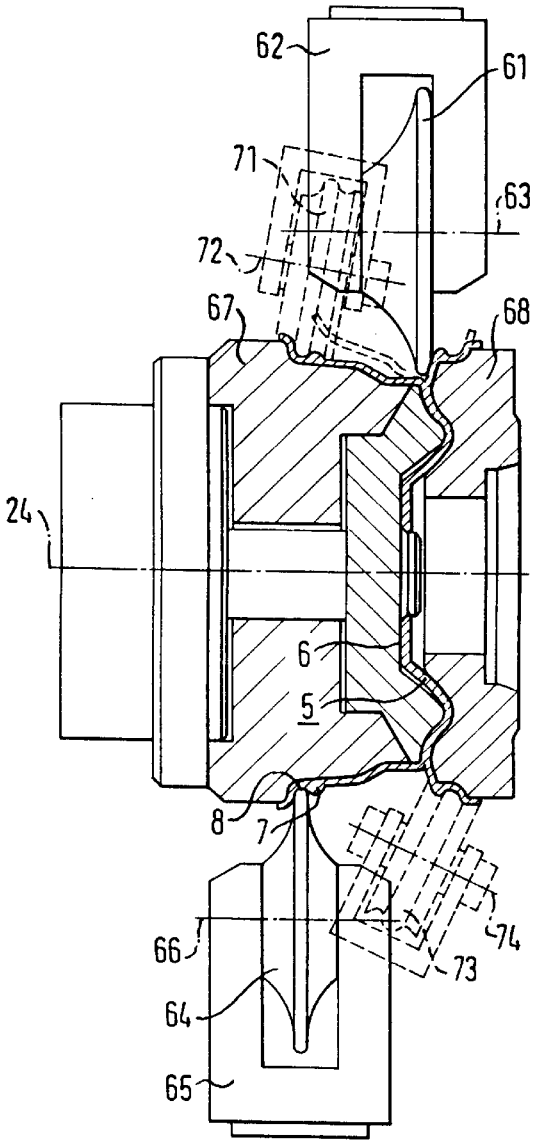
FIG. 5 illustrates a diagrammatic cross-sectional view of a circular blank during the subsequent shaping process.

The final shaping process is diagrammatically shown in FIG. 5. The intermediate shape 9 is shown in broken line form in the upper part of FIG. 5. Starting from the intermediate shape 9, by further spinning rolls 61, 64 the blank 10 is shaped to the final shape of a vehicle wheel 5. The spinning rolls 61, 64 are mounted so as to rotate about rotational axes 63, 66 on roll holders 62, 65, in the same way as the previously described spinning rolls.

The legs of the intermediate shape 9 are spun by the spinning rolls 61, 64 to the contours of further spinning chucks 67, 68, which have a comparable construction to the spinning chucks 57, 58 of FIG. 4. However, the contour of the spinning chucks 67, 68 is adapted to the shape of the end product.

As the final shaping process the lateral edge of a rim bed 8 is shaped by profiling rolls 71, 73. Roughly 2 cm from the lateral edge of the rim bed 8 are located humps 7, which are subsequently used for better fixing of a tire on the vehicle wheel. The profiling rolls 71, 73 have a corresponding contour for forming the marginal area. Unlike in the case of the previously described spinning rolls, the rotational axes 72, 74 of the profiling rolls 71, 73 can be inclined to the rotational axis 24.

At the end of the marginal shaping, a vehicle wheel 5 is provided having a central hub area with a large material thickness and a rim bed with a smaller material thickness. The degree of deformation of the legs 16, 17 of the blank 10 relative to the rim bed 8 is chosen in such a way that there is an adequate work-hardening of the material in the vicinity of the rim bed 8. Preferably ferrous metals or light metals are used as the material for the circular blank 10.

As described above, for increasing the reliability and accuracy of the splitting process, the outer circumferential area 11 may be provided with a serration 75 for guiding the splitting roll 41.

It is obvious that the method according to the invention can be used not only for the manufacture of a vehicle wheel, but also random other rotationally symmetrical parts, such as e.g., pulleys. Through the possibility of material gathering by an upsetting an the edge of the circular blank, in the case of such parts a particularly high design freedom is obtained during subsequent splitting and working of the blank.

What is claimed as new and desired to be secured by Letters Patent of the United States is:

1. Method of manufacturing of a rotationally symmetrical part in which a circular blank is clamped concentrically and rotatably about a rotational axis and a free outer circumferential area of the circular blank is upset by an upsetting roll for forming a material gathering and subsequently splitting the outer circumferential area into two legs by a splitting roll, which comprises:

supporting the outer circumferential area, during upsetting, on both sides of the circular blank by rotary support rolls, the support rolls having rotational axes which are substantially perpendicular to the rotational axis, wherein only one outer edge of the outer circumferential area is upset to the material gathering, and maintaining a non-upset remaining outer circumferential area; and shaping the material gathering by the upsetting roll and the support rolls.

2. Method according to claim 1, wherein the splitting of the blank is performed concentrically with respect to the thickness of the non-upset circular blank.

3. Method according to claim 1, which comprises forming the material gathering asymmetrically with respect to a centerline of a width portion of the blank in the outer circumferential area of the circular blank.

4. Method according to claim 3, wherein with the asymmetrical upsetting, a clearly defined material distribution with respect to the two legs is formed such that a first leg thereof has a greater amount of material than a second leg thereof.

5. Method according to one of the claim 1, which comprises performing the shaping with the upsetting roll.

6. Method according to one of the claim 1, which comprises forming the outer circumferential area of the material gathering substantially perpendicularly to a direction of splitting.

7. Method according to one of the claim 1, which comprises providing the outer circumferential area of the material gathering with a serration guiding the splitting roll.

8. Method according to claim 1, which comprises deforming, after splitting, the two legs by utilizing at least one spinning roll.

9. Method according to claim 1, which comprises shaping, prior to the upsetting, the circular blank.

10. Method according to claim 1, which comprises splitting the material gathering and the non-upset, outer circumferential area by the splitting roll for forming the two legs.

* * * * *